US010894182B2

(12) United States Patent
Yoon et al.

(10) Patent No.: US 10,894,182 B2
(45) Date of Patent: Jan. 19, 2021

(54) WALKING TRAINING APPARATUS

(71) Applicant: CUREXO, INC., Seoul (KR)

(72) Inventors: Dae Keun Yoon, Ulsan (KR); Suk Hoon Park, Ulsan (KR); Jeong Woo Han, Ulsan (KR)

(73) Assignee: CUREXO, INC., Seoul (KR)

( * ) Notice: Subject to any disclaimer, the term of this patent is extended or adjusted under 35 U.S.C. 154(b) by 69 days.

(21) Appl. No.: 16/320,323

(22) PCT Filed: Jul. 26, 2017

(86) PCT No.: PCT/KR2017/008040
§ 371 (c)(1),
(2) Date: Jan. 24, 2019

(87) PCT Pub. No.: WO2018/021817
PCT Pub. Date: Feb. 1, 2018

(65) Prior Publication Data

US 2019/0151710 A1 May 23, 2019

(30) Foreign Application Priority Data

Jul. 27, 2016 (KR) ..... 10-2016-0095515

(51) Int. Cl.
*A63B 23/04* (2006.01)
*A61H 3/00* (2006.01)
(Continued)

(52) U.S. Cl.
CPC ..... *A63B 23/0405* (2013.01); *A61H 1/0262* (2013.01); *A61H 3/00* (2013.01);
(Continued)

(58) Field of Classification Search
CPC ..... A63B 23/0405; A63B 21/00; A63B 23/04; A63B 21/00178; A63B 22/04; A63B 2022/0092; A63B 71/0054; A63B 22/0048; A63B 2225/093; A63B 2208/029; A63B 2071/0072; A63B 2225/09;
(Continued)

(56) References Cited

U.S. PATENT DOCUMENTS 9,486,385 B1 * 11/2016 Terrill ..... A61H 3/04
9,914,003 B2 * 3/2018 Kuehne ..... A63B 71/0009
(Continued)

FOREIGN PATENT DOCUMENTS

JP 2014-008250 A 1/2014
KR 10-2012-0062049 A 6/2012
(Continued)

*Primary Examiner* — Nyca T Nguyen
*Assistant Examiner* — Andrew M Kobylarz
(74) *Attorney, Agent, or Firm* — Novick, Kim & Lee, PLLC; Jae Youn Kim; Jihun Kim

(57) ABSTRACT

Provided is a walking training apparatus which includes: a main body to be ridden by a walking trainee; a footrest part coupled to the main body rotatably to support feet of the walking trainee; and an upper body support part coupled to the main body at a position spaced apart from the footrest part to support an upper body of the walking trainee and thus disperse load supported by the footrest part, wherein the upper body support part supports an armpit and a forearm of the walking trainee.

7 Claims, 5 Drawing Sheets

(51) Int. Cl.

| | |
|---|---|
| ***A63B 22/04*** | (2006.01) |
| ***A63B 21/00*** | (2006.01) |
| ***A61H 1/02*** | (2006.01) |
| ***A63B 22/00*** | (2006.01) |

(52) U.S. Cl.
CPC ..... *A61H 3/008* (2013.01); *A63B 21/00* (2013.01); *A63B 21/00178* (2013.01); *A63B 22/04* (2013.01); *A63B 23/04* (2013.01); *A61H 2003/006* (2013.01); *A63B 2022/0092* (2013.01)

(58) Field of Classification Search
CPC ..... A63B 2208/12; A63B 21/00181; A61H 1/0262; A61H 3/008; A61H 3/00; A61H 2003/006; A61H 1/0237
See application file for complete search history.

(56) References Cited

U.S. PATENT DOCUMENTS

| | | | | |
|---|---|---|---|---|
| 2014/0058299 | A1* | 2/2014 | Sankai ..... | A61H 3/00 601/35 |
| 2016/0007885 | A1* | 1/2016 | Basta ..... | G06F 19/3481 482/5 |
| 2017/0007489 | A1* | 1/2017 | Lin ..... | G16H 20/30 |
| 2017/0056275 | A1* | 3/2017 | Lee ..... | A61B 5/1038 |
| 2018/0250189 | A1* | 9/2018 | Johnson ..... | A61H 3/04 |

FOREIGN PATENT DOCUMENTS

| | | | |
|---|---|---|---|
| KR | 10-2012-0096378 | A | 8/2012 |
| KR | 10-2015-0078399 | A | 7/2015 |

* cited by examiner

WALKING TRAINING APPARATUS

TECHNICAL FIELD

The present invention relates to a walking training apparatus for performing walking training.

BACKGROUND ART

Generally, for people, walking is most fundamental and necessary movement in daily life. Thus, performing walking training for patients, who are unable to walk properly due to impaired neurological function caused by any disease or injury or due to imbalance of muscle, is the first gateway to return the patient to normal life.

There is a walking training apparatus of overhead harness type. The walking training apparatus of overhead harness type is an apparatus that hangs the upper body of the trainee to disperse a weight of the walking trainee loaded to the lower body and trains the walking trainee. However, the walking training apparatus of overhead harness type requires the trainee to wear a harness tightening vest which takes long time disadvantageously.

Conventional walking training apparatus to overcome problems of the overhead harness type is one of sitting type which requires the trainee not to wear the tightening vest but to sit on while walking training. The conventional walking training apparatus has a saddle and footrests, and the weight of the walking trainee is dispersed to the saddle and the footrests. However, the conventional walking training apparatus has the following problems.

First, when using the conventional walking training apparatus, the more difficultly the patient walks, the more heavily the weight of the patient is loaded to the saddle. So, when using the conventional walking training apparatus, the crotch part of the patient is pressed a lot to cause pain and the patient who has thick thighs would have a scratch due to a friction between an inner part of the thigh and the saddle.

Second, using the conventional walking training apparatus, as the weight loaded on the saddle is increased, the patient is used just to pedal and thus it is not useful to train the walking.

DETAILED DESCRIPTION OF THE INVENTION

Technical Problem

The present invention is supposed to provide a walking training apparatus which prevents pain and scratch due to the crotch pressures of the walking trainee and thus to solve the above-mentioned problem.

The present invention is supposed to provide a walking training apparatus which a walking trainee rides on quickly and almost real walking training is feasible on.

Solution to Problem

In order to solve the above-mentioned problems, the present invention can include the following configuration.

The walking training apparatus according to the present invention may comprise a main body to be ridden by a walking trainee; a footrest part coupled to the main body rotatably to support feet of the walking trainee; and an upper body support part coupled to the main body at a position spaced apart from the footrest part to support the upper body of the walking trainee and thus disperse load supported by the footrest part. The upper body support part supports an armpit and a forearm of the walking trainee.

The upper body support part may comprise a pair of first support apparatus for supporting the armpit of the walking trainee, a pair of second support apparatus respectively coupled to the pair of first support apparatus to support the forearm of the walking trainee, a third support apparatus coupled to the pair of second support apparatus and an elevating apparatus coupled to the third support apparatus in the way to make it go up and down.

The upper body support part is formed in the second support apparatus, and may comprise the fourth support apparatus for preventing an elbow of the walking trainee from being separated from the second support apparatus.

Also, the upper body support part is coupled to the second support apparatus, and may comprise a handle part for the walking trainee to hold by hand for supporting.

The first support apparatus may comprise a plurality of first coupled holes to be coupled to the second support apparatus. The plurality of the first coupled holes may be formed apart from each other in the first support apparatus so that the first support apparatus is movable according to a thickness of the armpit of the walking trainee.

The first support apparatus may be formed as round type to prevent the walking trainee from falling forward on walking training.

The elevating apparatus may rotate in a clockwise or counterclockwise direction to elevate the third support apparatus.

The Effect of Invention

According to the present invention, following effects can be obtained.

The present invention has the configuration to disperse the weight of the walking trainee on the parts of the armpit and the elbow so as to prevent pain and scratch in the crotch of the walking trainee.

The present invention does not have a lift apparatus for giving the walking trainee a ride to shorten the riding time of the walking trainee. Also, it implements natural walking training motion similar with real walking motion without the saddle so that the walking trainee would not feel a sense of difference.

BRIEF DESCRIPTION DRAWINGS

MODE FOR THE INVENTION

In the present enclosure, it is noted that the same reference number is used to denote the same element even if it is shown in the other drawings.

Meanwhile, the meaning of terms described in the present invention should be understood as follows.

The singular expressions are to be understood as including plural expressions unless the context clearly defines differently, and terms like "the first", "the second" are used to distinguish one element from other element, which should be not understood to limit the scope of the present invention.

It should be understood that the terms like "comprise" or "have" do not preclude of one or more other features, numbers, steps, movements, elements, components, or the presence of combinations thereof or additional possibility.

It should be understood that the term of "at least one" comprises all possible combinations that can be presented from one or more related items. For example, "at least one of the first item, the second item and the third item" means combinations of all items that can be presented from two or more of the first item, the second item and the third item as well as the first item, the second item or the third item.

Hereinafter, a walking training apparatus according to the present invention will be described in detail with reference to attached drawings.

Figure 1:
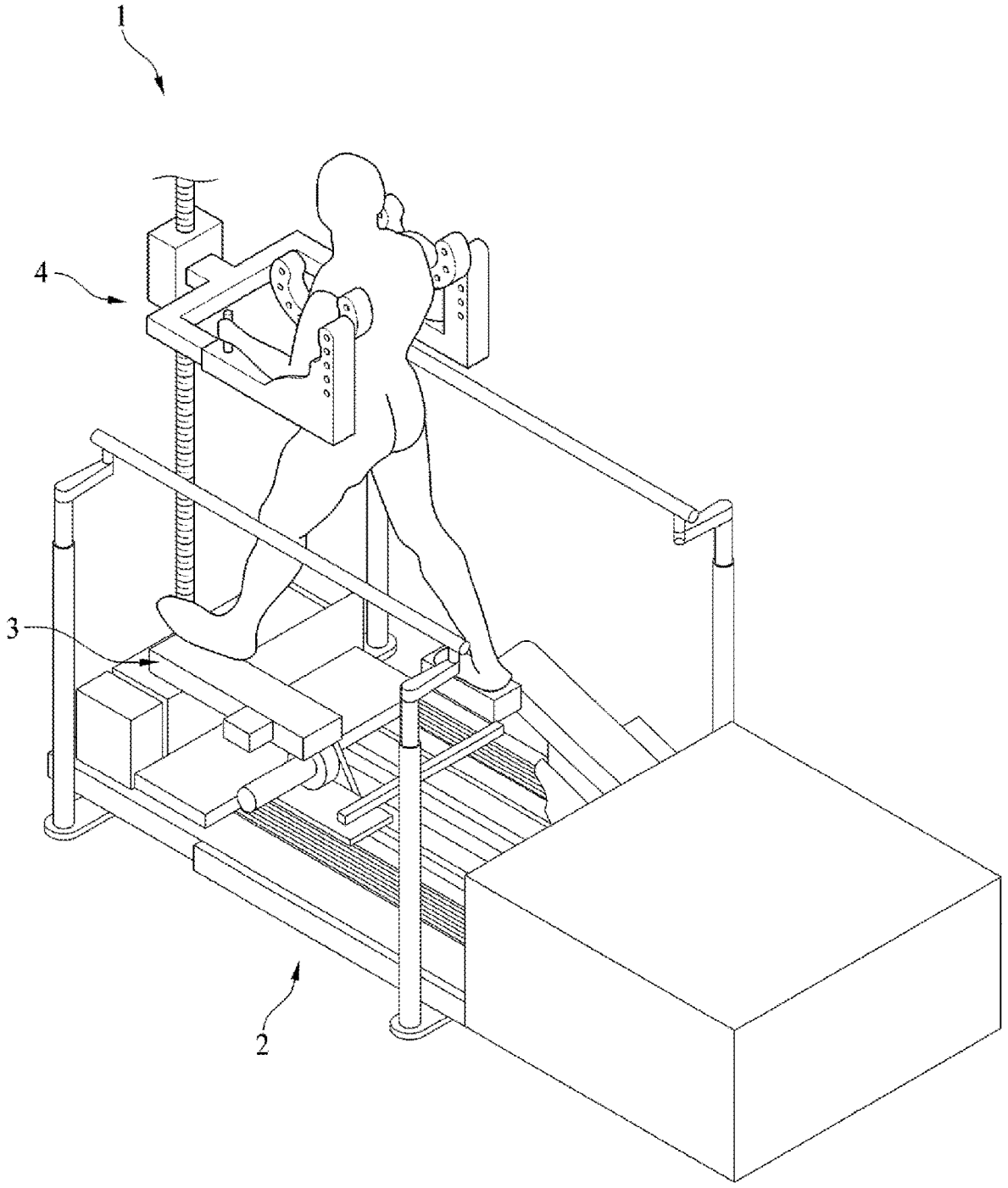
FIG. 1 is a schematic perspective view of a walking training apparatus according to the present invention.
Figure 2:
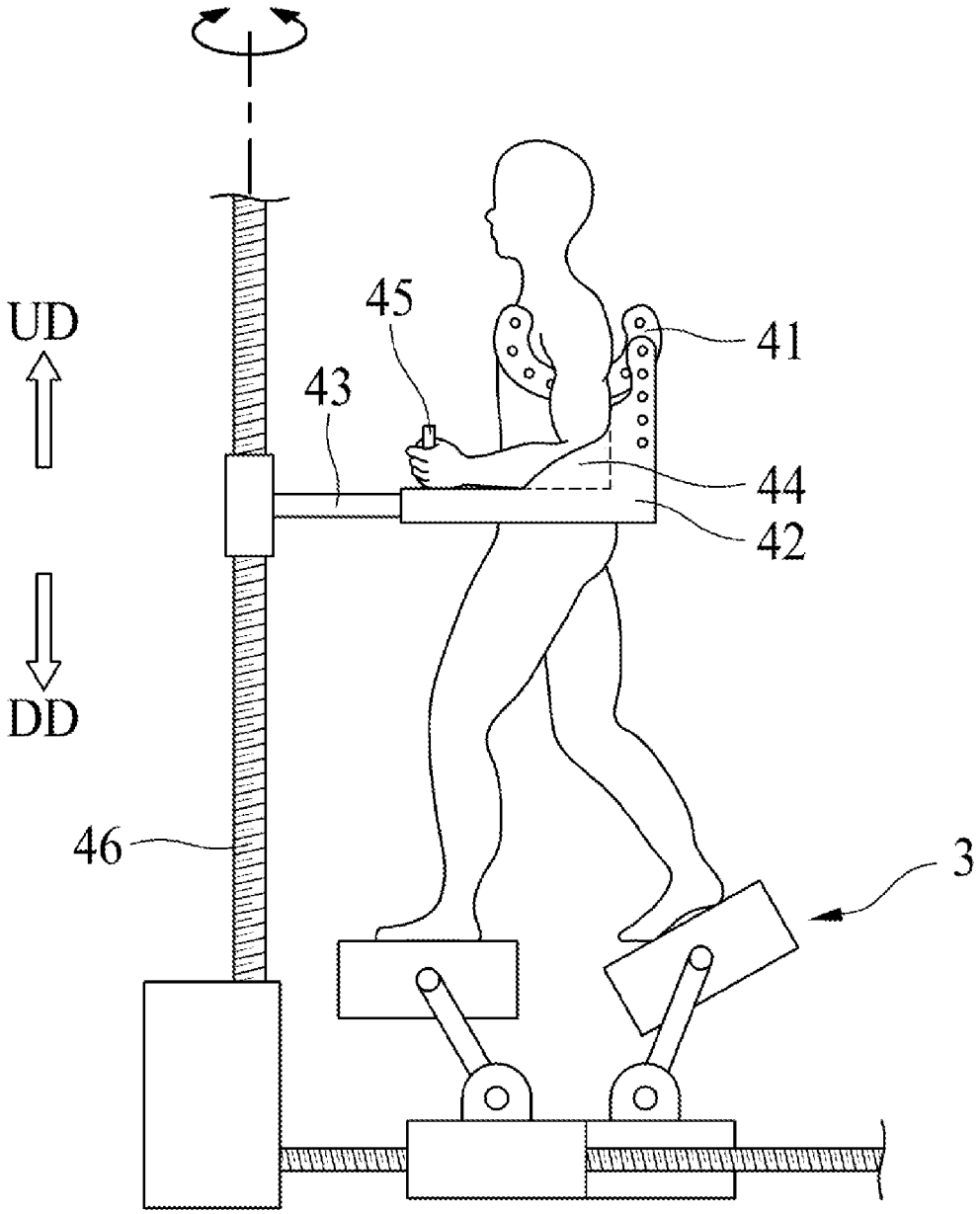
FIG. 2 is a schematic side view of the walking training apparatus according to the present invention.
Figure 3:
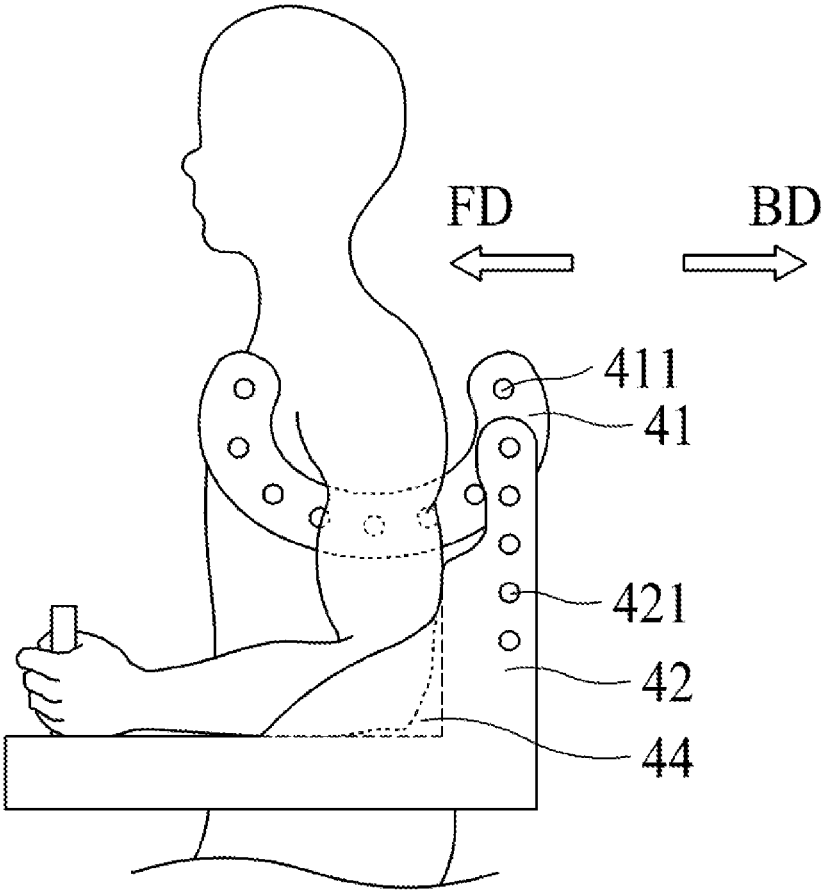
FIG. 3 is a schematic side view for explaining the first support apparatus in the walking training apparatus according to the present invention.
Figure 4:
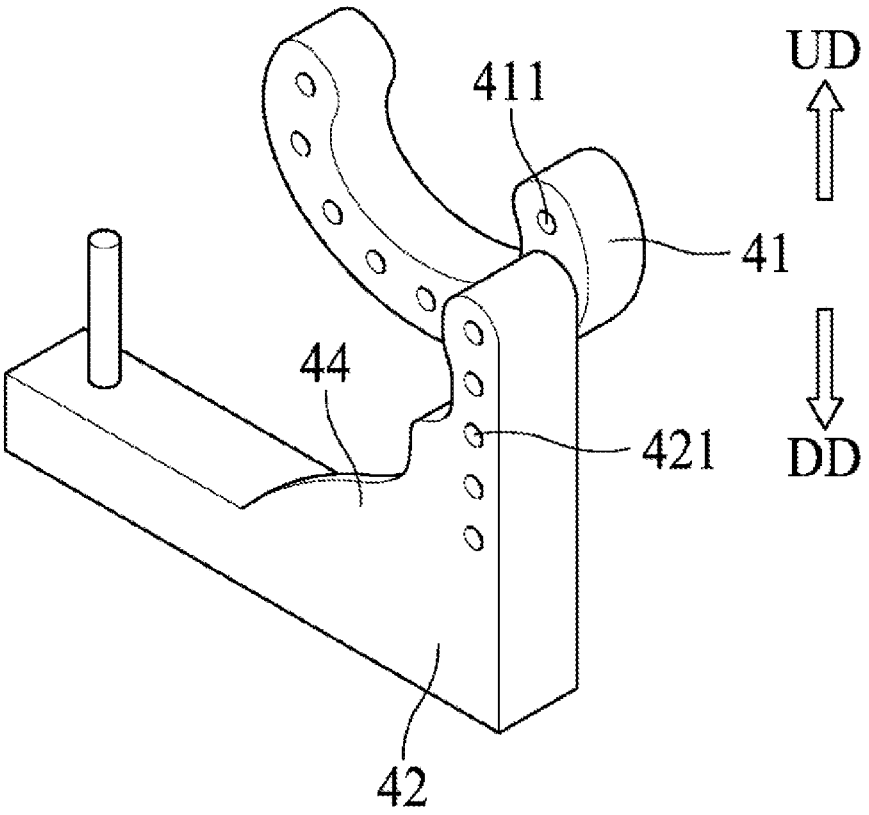
FIG. 4 is a schematic side view for explaining the second support apparatus in the walking training apparatus according to the present invention.
Figure 5:
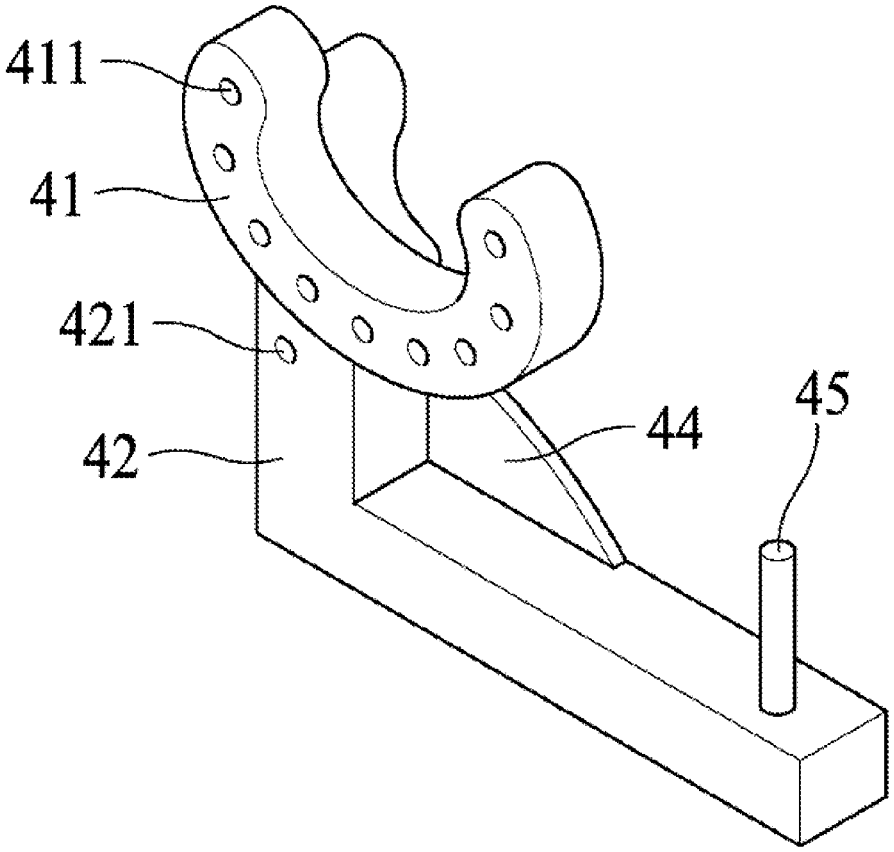
FIG. 5 is a schematic perspective view for explaining the fourth support apparatus in the walking training apparatus according to the present invention.

FIG. 1 is a schematic perspective view of the walking training apparatus according to the present invention, FIG. 2 is a schematic side view of a walking training apparatus according to the present invention, FIG. 3 is a schematic side view for explaining the first support apparatus in a walking training apparatus according to the present invention, FIG. 4 is a schematic side view for explaining the second support apparatus in a walking training apparatus according to the present invention and FIG. 5 is a schematic perspective view for explaining the fourth support apparatus in a walking training apparatus according to the present invention.

Referring to FIGS. 1 to 5, the walking training apparatus 1 according to the present invention is supposed to support an upper body of the walking trainee who performs walking training. Particularly, the walking training apparatus 1 according to the present invention supports armpit and forearm of the walking trainee to prevent a weight of a walking trainee from concentrating on the lower body and to help natural walking training of the walking trainee.

For this, the walking training apparatus 1 according to the present invention comprises the main body 2, the footrest part 3 and the upper body support part 4.

The walking training apparatus 1 according to the present invention is implemented to provide the walking training as if the walking trainee walks on crutches, so that it minimizes a sense of difference when the walking trainee recovers and walks actually. The walking trainee may be not only one who has hemiplegia but also one, who cannot support his/her own weight, such as one who is not free to walk due to brain or nerve damage.

Hereinafter, the main body 2, the footrest 3 and the upper body support part 4 will be described in detail with reference to attached drawings.

Referring to FIG. 1 to FIG. 5, the main body 2 is for giving the walking trainee a ride. The main body 2 may be installed on a floor. The main body 2 may be supported on the floor to support the walking trainee. The main body 2 would be formed in a rectangular shape overall, and be thick so the trainee may be positioned higher than the floor. Accordingly, the walking trainee may perform walking training at the high position spaced apart from the floor. The footrest 3 and the upper body support 4 part may be coupled with the main body 2. Also, the main body 2 may be coupled with a movement support which the walking trainee holds by hand to support the weight when moving and stepping on the footrest 3. Although not be shown, the main body 2 may be detachably coupled with a slope plate which is slantly formed so that a wheelchair can go up. The slope plate may be coupled to one side of the main body 2 opposite to the other side of the main body 2 which the upper body support part 4 is coupled to.

The footrest part 3 is to support feet of the walking trainee. The footrest part 3 may support the feet of the walking trainee after the walking trainee rides. The footrest part 3 is installed as a left-right pair to support left and right feet of the walking trainee respectively. The footrest part 3 is positioned at a low position so that a weak walking trainee can step on easily such as one having hemiplegia, the weak, the elderly and so on. The footrest part 3 is formed in a rectangular shape overall, so that the walking trainee can put the feet on and balance stably to perform walking training. The footrest 3 may be coupled to the main body 2 rotatably. By rotating the footrest 3, the walking trainee can repeatedly contract and relax muscles which are necessary for walking, so that the muscles for walking may be strengthened. Also, it is used to train the part related to brain and nerve, such as reflex action for the walking trainee's maintaining the body balance for walking. The footrest part 3 may be rotated to position at a left and right opposite side. The footrest 3 may be rotated so that the left and right are simultaneously positioned in a forward direction (FD, shown in FIG. 3) or a backward direction (BD, shown in FIG. 3). Accordingly, the walking trainee can strengthen muscles which are suitable for various situations such as moving the feet respectively or simultaneously. The footrest 3 may be rotated by a foot movement part (not shown) which comprises a motor, a cylinder, and a belt.

The upper body support part 4 supports the upper body of the walking trainee and thus disperses load supported by the footrest part 3. The upper body support part 4 may support the armpit and the forearm of the walking trainee. The upper body support part 4 may be coupled to the main body 2 at a position spaced apart from the footrest part 3. Accordingly, the upper body support part 4 may not interfere with a rotation of the footrest 3. Specifically, the upper body support part 4 may be coupled to the main body 2 at a position in an upper direction (UD, shown in FIG. 2) as compared with the footrest part 3. The upper body support part 4 may be coupled to the main body 2 movably from the upper side of the footrest 3 to an upper direction (UD, shown in FIG. 2) or a lower direction (DD, shown in FIG. 2). The upper body support part 4 may be moved in the lower direction (DD) to a position being adjacent to the footrest part 3 so that the walking trainee supports his/her upper body easily when the walking trainee riding. After the walking trainee rides, the upper body support part 4 may be moved to the upper direction (UD) with supporting the upper body of the walking trainee, so that the walking trainee keeps standing and performs the walking training. When performing the walking training, the upper body support part 4 may be moved to the upper direction (UD) or the lower direction (DD) slightly so that the walking trainee performs natural walking. The upper body support part 4 may comprise a first support apparatus 41, a second support apparatus 42, a third support apparatus 43, a fourth support apparatus 44, a handle part 45 and an elevating apparatus 46.

The first support apparatus 41 is to support the armpit of the walking trainee. The first support apparatus 41 may be equipped as a pair of left and right to support the left and right armpits of the walking trainee respectively. The pair of the first support apparatus 41 is respectively positioned to contact the left and right armpits of the walking trainee, so that it may support the left and right armpits of the walking trainee. The first support apparatus 41 may be formed as round shape to prevent the walking trainee from falling forward. For example, the first support apparatus 41 may be formed as half-round shape. The first support apparatus 41 may prevent the walking trainee from falling forward by supporting the front shoulder of the walking trainee when the upper body of the walking trainee is inclined in the forward direction FD. The first support apparatus 41 may also prevent the walking trainee from falling backward by supporting the back shoulder of the walking trainee when the upper body of the walking trainee is inclined in the backward direction BD. The first support apparatus 41 may comprise a plurality of first coupled holes 411.

The plurality of the first coupled holes 411 may be formed through the first support apparatus 41 so that the first support apparatus 41 is coupled to the second support apparatus 42. The first coupled holes 411 may be formed through the first support apparatus 41 in a vertical direction perpendicular to the forward direction and the backward direction. The first coupled holes 411 may be formed apart from each other in the first support apparatus 41 so that the first support apparatus 41 is movable from the second support apparatus 42 according to a thickness of the armpit of the walking trainee. For example, the first coupled holes 411 may be formed apart from each other in the first support apparatus 41 from the forward direction FD to the backward direction BD. The thickness of the armpit means the length of the armpit of the walking trainee in the forward direction FD and the backward direction BD. For example, when the thickness of the armpit of the walking trainee is thick, like an adult man, the first support apparatus 41 may be moved in the forward direction FD to be coupled to the second support apparatus 42. Accordingly, as the first support apparatus 41 may prevent the armpit of the walking trainee from being tightened and also prevent the arm of the walking trainee from being constrained to the second support apparatus 42 during the walking training, the walking trainee may perform the natural walking training. For example, when the thickness of the armpit of the walking trainee is thin, such as a woman or a child, the first support apparatus 41 may be moved in the backward direction BD to be coupled to the second support apparatus 42. Accordingly, the first support apparatus 41 may prevent the armpit of the walking trainee from being loosed, so it may prevent the walking trainee from performing the walking training in a tilted state in the forward direction FD or the backward direction BD.

The second support apparatus 42 may be equipped as a pair to be coupled to the pair of the first support apparatus 41 respectively. The second support apparatus 42 is to support the left and right forearms of the walking trainee respectively. For this, the second support apparatus 42 may be equipped in the left and right sides of the upper body of the walking trainee. The second support apparatus 42 may be formed in a '⌋' shape overall. The forearms of the walking trainee may be supported in the '-' area of the second support apparatus 42. To be specific, the '-' area of the second support apparatus 42 may support the lower arm of the walking trainee. The '⌉' area of the second support apparatus 42 may prevent the upper arm of the walking trainee from moving in the backward direction BD and thus prevent the walking trainee from falling backward. The second support apparatus 42 may be positioned in the lower side of the first support apparatus 41. So, the first support apparatus 41 may support the armpit of the walking trainee and the second support apparatus 42 may support the forearm of the walking trainee. The '⌉' area of the second support apparatus 42 may be coupled to the first support apparatus 41 movably in the up and down direction. The second support apparatus 42 may comprise a plurality of the second coupled holes 421 so that the first support apparatus 41 might move in up and down direction.

The plurality of the second coupled holes 421 may be formed apart from each other in the up and down direction in the second support apparatus 42 so that the first support apparatus 41 may be movable according to the arm length of the walking trainee. The plurality of the second coupled holes 421 may be formed through the second support apparatus 42 in a vertical direction perpendicular to the forward direction FD and the backward direction BD. In this case, the second coupled holes 421 may be formed in the second support apparatus 42 to be connected with the first coupled holes 411 in a line. Although not shown, the first support apparatus 41 and the second support apparatus 42 may be coupled each other through a fixing apparatus inserted respectively into some of the first coupled holes 411 and some of the second coupled holes 421. The first coupled holes 411, the second coupled holes 421 and the fixing apparatus are formed as a polygonal shape having the same cross section respectively, so that it may prevent the first support apparatus 41 from rotating around the second support apparatus 42. The arm length of the walking trainee may be the arm length which is sum of the upper arm the lower arm of the walking trainee, but it may mean only the length of the upper arm. For example, when the length of the armpit of the walking trainee is long, like an adult man, the first support apparatus 41 may be moved in the upper direction UD to be coupled to the second support apparatus 42. In this case, the first coupled holes 411 may be positioned to be connected in a line with the second coupled holes 421 positioned in the upper direction UD among the second coupled holes 421. For example, when the length of the arm of the walking trainee is short, such as a woman or a child, the first support apparatus 41 may be moved in the lower direction DD to be coupled to the second support apparatus 42. In this case, the first coupled holes 411 may be positioned to be connected in a line with the second coupled holes 421 positioned in the lower direction DD among the second coupled holes 421. Accordingly, the walking trainee may perform the walking training with supporting the forearms with the second support apparatus 42.

The third support apparatus 43 may be coupled to the pair of the second support apparatus 42 respectively. One side of the third support apparatus 43 may be coupled to the elevating apparatus 46 and the other side may be coupled to the second support apparatus 42. Accordingly, the third support apparatus 43 may be supported by the elevating apparatus 46 to support the second support apparatus 42 and the first support apparatus 41. The third support apparatus 43 may be formed as a '⊏' shape overall where the other side is open. The third support apparatus 43 may be coupled to the elevating apparatus 46 movably. Threads may be formed in the one side of the third support apparatus 43 coupled to the elevating apparatus 46. The third support apparatus 43 may be moved in the upper direction UD or in the lower direction DD as the elevating apparatus 46 rotates in a clockwise or counterclockwise direction. The third support apparatus 43 may be moved in the lower direction DD when the walking trainee rides. The third support apparatus 43 may reciprocate within a predetermined distance in the upper direction UD and in the lower direction DD when the walking trainee performs the walking training.

The fourth support apparatus 44 is formed in the second support apparatus 42 and prevents the elbow of the walking trainee from being separated from the second support apparatus 42. The fourth support apparatus 44 may be formed in each of the pair of the second support apparatus 42. The fourth support apparatus 44 may be formed in the second support apparatus 42 to be positioned at the meeting portion of the '-' part and the ']' part of the second support apparatus 42. The fourth support apparatus 44 prevents the elbow of the walking trainee from being separated in an outward direction opposite to an inward direction, where the walking trainee is positioned, with respect to the second support apparatus 42.

Accordingly, the fourth support apparatus 44 may be formed in the second support apparatus 42 to be positioned outwardly in the planar view of the second support apparatus 42. Although not shown, the fourth support apparatus 44 may be formed in the second support apparatus 42 to be positioned in both the inward and outward direction, further to prevent it from being separated in the inward direction. In this case, the elbow of the walking trainee may be positioned between the fourth support apparatus 44 located in the inward direction and the fourth support apparatus 44 located in the outward direction. The fourth support apparatus 44 may be manufactured and formed integrally with the second support apparatus 42 in a mold. But not limited to this, it may be manufactured separately and may be coupled to the second support apparatus 42 as welding or gluing etc.

The handle part 45 is coupled to the second support part 42, and the walking trainee holds it by hand and leans on it. The handle part 45 may be coupled to the second support part 42 to be positioned at the other side opposite to the one side of the second support part 42 which is coupled to the first support part 41. The handle part 45 may be coupled to the second support apparatus 42 to protrude in the upper direction UD from the second support apparatus 42. The handle part 45 may be formed as a cylinder shape. But it is not limited to this and also it may be formed as shape of a polygonal pillar. Accordingly, the upper arm of the walking trainee may lean on the ']' area of the second support apparatus 42, the lower arm may lean on the '-' area of the second support apparatus 42, and the walking trainee may grasp the handle part 45 with hand. Therefore, even if the armpit and the elbow are separated from the first support apparatus 41 and the second support apparatus 42 during the walking training, the walking trainee may grasp the handle part 45 by hand, so that it may prevent from falling out from the upper body support part 4.

The elevating apparatus 46 may be coupled to the third support apparatus 43 in the way to make it go up and down. The elevating apparatus 46 may be coupled to the main body 2 rotatably. Although not shown, a driving motor may be installed in the inside of the main body 2 to be coupled to the elevating apparatus 46 and generate driving power for rotating the elevating apparatus 46. Accordingly, the elevating apparatus 46 may be rotated by the driving motor. The elevating apparatus 46 may rotate in a clockwise or counterclockwise direction to elevate the third support apparatus 43.

For example, when the elevating apparatus 46 rotates in a clockwise, the third support apparatus 43 may be moved in the upper direction UD, and when the elevating apparatus 46 rotates in a counterclockwise, the third support apparatus 43 may be moved in the lower direction DD. On the contrary to this, the third support apparatus 43 may be moved in the lower direction DD if the elevating apparatus 46 rotates in a clockwise, and also moved in the upper direction UD if the elevating apparatus 46 rotates in a counterclockwise. The second support apparatus 42 and the first support apparatus 41 may also be moved up or down as the third support apparatus 43 moves up or down on the elevating apparatus 46. For example, the elevating apparatus 46 may be a lead screw. The elevating apparatus 46 may move the third support apparatus 43 in the lower direction DD so that the walking trainee might lean the armpit and the forearm on the first support apparatus 41 and the second support apparatus 42 easily when the walking trainee rides. The elevating apparatus 46 may move the third support apparatus 43 in the upper direction UD after the first support apparatus 41 and the second support apparatus 42 support the armpit and the forearm of the walking trainee. So, the walking training apparatus 1 according to the present invention may allow the walking trainee to ride on the upper body support part 4 easily. The elevating apparatus 46 may rotate periodically in a clockwise or counterclockwise direction so that the third support apparatus 43 might reciprocate within a predetermined distance in the upper direction and the lower direction DD during the walking training. Accordingly, the walking training apparatus 1 according to the present invention has the walking trainee walk on almost real walking trajectory to prevent the walking trainee from feeling a sense of difference after recovering.

The present invention is not limited to the above-described embodiment and the accompanying drawings, because it will be apparent to those skilled in the art that various modifications, substitutions and alterations will be possible without departing from the technical idea of the invention.

What is claimed is:

1. A walking training apparatus comprising:

a main body configured to be ridden by a walking trainee, a footrest part rotatably coupled to the main body to support feet of the walking trainee; and an upper body support part coupled to the main body at a position spaced apart from the footrest part to support an upper body of the walking trainee and disperse load supported by the footrest part, wherein the upper body support part includes:

a pair of first support devices for supporting armpits of the walking trainee, the pair of first support devices respectively having a round shape to support a front shoulder and a back shoulder of the walking trainee so as to prevent the walking trainee from falling forward or backward during walking training; and a pair of second support devices respectively coupled to the pair of first support devices to support a forearm of the walking trainee;

wherein each of the pair of first support devices has a plurality of first coupling holes configured to be coupled to the respective second support device, and wherein the plurality of the first coupling holes are located apart from each other in forward and backward directions, such that each of the pair of first support devices is movable relative to the respective second support device in the forward or backward direction according to a thickness of the respective armpit of the walking trainee.

2. The walking training apparatus according to claim 1, wherein the upper body support part further includes:

a third support device coupled to the pair of second support devices; and an elevating device coupled to the third support device to enable the third support device to move up and down.

3. The walking training apparatus according to claim 2, wherein the upper body support part further includes:

a pair of fourth support devices for preventing elbows of the walking trainee from being separated from the pair of second support devices, wherein the pair of fourth support devices are respectively protruded from the pair of second support devices.

4. The walking training apparatus according to claim 2, wherein the upper body support part further includes a pair of handle parts configured to be gripped by hands of the walking trainee, and wherein the pair of handle parts are respectively coupled to the pair of second support devices.

5. The walking training apparatus according to claim 2, wherein the elevating device is configured to rotate in a clockwise or counterclockwise direction to elevate the third support device.

6. The walking training apparatus according to claim 1, wherein each of the pair of second support devices has a plurality of second coupling holes configured to be coupled with the respective first support device, and wherein the plurality of the second coupling holes are located spaced apart and in up and down directions from each other in each of the pair of second support devices, such that the respective first support device is movable according to a length of an arm of the walking trainee.

7. The walking training apparatus according to claim 1, wherein the pair of first support devices has a half-round shape to support the front shoulder of the walking trainee when the upper body of the walking trainee is inclined in the forward direction and support the back shoulder of the walking trainee when the upper body of the walking trainee is inclined in the backward direction.

* * * * *